US007814845B2

(12) United States Patent
Brookes

(10) Patent No.: US 7,814,845 B2
(45) Date of Patent: Oct. 19, 2010

(54) DUAL CHAMBER SYSTEM FOR GASIFYING BIOMASS WASTE

(75) Inventor: David Brookes, Mississauga (CA)

(73) Assignee: Zebrex Environmental Systems, Mississauga (CA)

( * ) Notice: Subject to any disclaimer, the term of this patent is extended or adjusted under 35 U.S.C. 154(b) by 475 days.

(21) Appl. No.: 11/763,916

(22) Filed: Jun. 15, 2007

(65) Prior Publication Data

US 2008/0308017 A1 Dec. 18, 2008

(51) Int. Cl.
*F23B 10/00* (2006.01)
*F23B 80/00* (2006.01)
*F23G 5/027* (2006.01)

(52) U.S. Cl. ..... 110/229; 110/210

(58) Field of Classification Search ..... 110/107, 110/110, 229, 224, 225, 221; 414/175, 190
See application file for complete search history.

(56) References Cited

U.S. PATENT DOCUMENTS

| | | | | |
|---|---|---|---|---|
| 1,742,868 | A | 1/1930 | Mann | |
| 2,592,730 | A | 4/1952 | Perkins | |
| 3,792,671 | A | 2/1974 | Woods | |
| 4,321,878 | A | 3/1982 | Segrest | |
| 4,401,038 | A | 8/1983 | Segrest | |
| 4,483,256 | A | 11/1984 | Brashear | |
| 4,603,644 | A | 8/1986 | Brookes | |
| 5,014,630 | A | 5/1991 | Looker | |
| 5,095,826 | A | 3/1992 | Erisson et al. | |
| 5,611,289 | A * | 3/1997 | Brookes | 110/194 |
| 5,655,465 | A | 8/1997 | Robertson | |
| 6,116,168 | A | 9/2000 | Brookes | |
| 6,352,040 | B1 * | 3/2002 | Voorhees et al. | 110/237 |
| 7,228,806 | B2 * | 6/2007 | Dueck et al. | 110/266 |

FOREIGN PATENT DOCUMENTS

| | | |
|---|---|---|
| CH | 550970 | 6/1974 |
| GB | 966236 | 8/1964 |

* cited by examiner

*Primary Examiner*—Kenneth B Rinehart
*Assistant Examiner*—David J. Laux
(74) *Attorney, Agent, or Firm*—Gerald A. Gowan; Gowan Intellectual Property

(57) ABSTRACT

A device for gasifying biomass waste has two each of primary chambers, fume transfer vents, mixing chambers which accept fumes from the primary chamber, afterburner chambers in fluid communication with the mixing chambers, and an exhaust duct. Each secondary burner produces an initial heating flame within a vertical portion of the respective afterburner chamber, and secondary chambers are in fluid communication with the afterburner chambers. Heated gases from the afterburner chambers cause heating of the secondary chambers. A portion of each primary chamber has a heat conductive floor superimposed over the respective secondary chamber, and the partition between the primary chambers is heat conductive, so that conductive and convective heating of the primary chambers occurs.

5 Claims, 9 Drawing Sheets

PRIOR ART

SINGLE CHAMBER HEAT CYCLE

DUAL CHAMBER HEAT CYCLE

DUAL CHAMBER SYSTEM FOR GASIFYING BIOMASS WASTE

STATEMENT OF GOVERNMENT INTEREST

This project is being funded by the U.S. government under TSWG Contract No. W91CRB-06-C-0007 and the U.S. government has certain rights in this invention.

FIELD OF THE INVENTION

This invention relates to incinerators and gasifiers for processing biomass waste, and particularly for processing biomass waste in alternating batches through one or the other of two adjacent primary incineration chambers, in such a manner that the biomass waste may be said to be disposed of in a "continuing batch loading system". As will be discussed hereafter, incinerators and gasifiers in keeping with the present invention share an exhaust flow system, but otherwise they comprise two separately operated primary and secondary incineration and gasification systems whose shared exhaust gases are environmentally benign.

BACKGROUND OF THE INVENTION

While discussion of the present invention, hereafter, will relate to its potential mobility, the main intent of the present invention is to provide an economical device which can dispose of biomass waste quickly and efficiently, in a pair of adjacent primary incineration chambers with underlying secondary gasification chambers, where heat transfer between primary chambers and from secondary chambers to the primary chambers is taken advantage of so that the device is fuel efficient. Moreover, the present invention provides such a device that can handle a variety of diverse biomass waste loads wherein the nature of the load may range from a macerated load having pieces of biomass waste in the range of 2 to 10 cm up to biomass waste loads that may be such that they cannot be macerated or otherwise divided, and also may be in the range of at least several hundred kilograms in weight.

Where the present invention finds particular value is in emergency situations when a very large biomass waste must be disposed of quickly and safely. An example is an instance where avian flu may strike a poultry flock that might comprise 100,000 turkeys or chickens, each weighing up to 10 kg, or more. While not every bird will be affected, typically the Public Health Authorities will order that the entire flock be destroyed. Moreover, it is unwise, unsafe, unsanitary, and in some ways expensive, to bury the flock of birds. If they are buried, significant costs are encountered; but more particularly, the infection agents which spread the disease are still present underground. Those infection agents are typically viruses or prions which are very hardy proteins that can only be destroyed by being gasified and therefore by being molecularly disassembled at high temperatures. Such temperatures are typically in the range of 850° C. up to 1000° C.

The present inventor has previously made available to the public incinerators and gasifiers which will operate in the necessary temperature range, but the need for such incinerators and gasifiers to be capable of handling a variety of biomass loads which may vary significantly in their characteristics has become more and more apparent as natural and terrorist disasters can and may occur. For example, as noted above, flocks of poultry such as chickens, ducks, turkeys, and so on, may become infected with avian flu; herds of cattle may become infected with the "mad cow disease", herds of cattle or swine may become infected with anthrax, and so on. Typically, in such instances, only a few individual animals are specifically infected, but because of the risk of spread of the disease, the authorities will generally order destruction of the entire flock or herd.

Other instances where it may be necessary to dispose of a huge quantity of biomass waste in a short period of time can occur in instances where communities or rural areas may be subjected to the ravages of hurricanes, typhoons, tornadoes, tsunamis, floods, and so on. The Southeast Asia tsunami which affected millions of people from Thailand to Sri Lanka, or Hurricane Katrina which affected millions of people in Louisiana, Mississippi, and Texas, are examples of the kind of disaster where if incinerators and gasifiers of the sort described herein had been available, there would probably have been considerably less spread of disease as a consequence of rotting bodies of people, pets, fish, livestock, and so on. If those dead bodies could have been recovered and incinerated and gasified in keeping with the present invention, as described hereafter, there could have been considerable savings in disposal costs, health and welfare costs, the continuing health and welfare costs because of illnesses and disabilities that have occurred, and so on.

Thus, the challenge is to provide devices and a system which will dispose of various kinds of biomass waste quickly, effectively, and economically, preferably at or very near the site where the biomass waste is located. It is not advised, generally, to permit the burial of biomass waste, particularly of animals of all kinds, including people, if they have been killed in large quantities as a consequence of natural or terrorist disasters, or if they have been infected as part of a pandemic of such diseases as mad cow disease, avian flu, anthrax, smallpox, and others. In other words, there is much more likelihood in the future for the disposal of biomass waste such as dead bodies of any kind of creatures ranging from fish to foul to livestock to people.

It is desirable to heat all of such biomass materials so that the organic matter is converted to gases, preferably harmless gases such as elemental hydrogen and oxygen, which oxidize to water vapor, and carbon which oxidizes to carbon dioxide, as well as residual compounds and elements. The residuals, which are typically solids at ambient room or environmental temperature, should end up as inert mineral materials.

In order to accomplish the reduction of such biomass waste and related volatile solids into relatively inert gases and minerals salts, alloys, or other compounds, it is necessary to heat these materials sufficiently so as to break the chemical bonds between the molecular structures. Intense heating is required to break the various chemical bonds, such as hydrogen-carbon bonds. It is necessary that essentially all of the hydrogen-carbon bonds be broken, as the bonds are typically found in organic material, which organic material must be destroyed. Such extreme heating of biomass waste materials in this manner is known as pyrolysis, which is defined as chemical decomposition by the action of heat. Typically, pyrolysis is carried out at temperatures in the order of 850° C. to 1000° C. The ash material that is ideally produced, which ash material is composed mostly of mineral salts, will glow an orangey-red color when it is at 1000° C. and will ultimately be a white ash when it has cooled. The main constituents of the organic materials, namely hydrogen and carbon, are gasified, to form mainly carbon dioxide and water.

What is not desirable and is even unacceptable as an end product, is black colored ash. Such black colored ash indicates that the ash is not completely reduced and that there is still carbon and hydrocarbon material, among other materials, in the ash. The ash, therefore, might contain organic material therein, which organic material might even be in the form of bacteria, viruses, or prions, or it might be chemical compounds, including toxic materials, such as dioxins, furans and other organo-chlorides.

Basically, the heat causes the waste material to process itself, which processing mostly includes the pyrolytic breaking of the various chemical bonds, such as hydrogen-carbon bonds so as to permit gasification of all the materials possible.

Briefly, incineration of a biomass comprises two stages, the gasification stage and the carbon stage. In the first, gasification, stage, gases are driven off from the biomass as it is being heated—that is to say, as it absorbs heat—and such gases comprise water, hydrocarbon gases such as methane and the like, and other volatile organic compounds (VOC). As the gasification stage comes to an end, the remaining material will typically be a dry powder-like substance comprising particularly carbon and other minerals. During the carbon stage of incineration, the carbon is oxidized, typically by providing additional air flow; and carbon dioxide will be driven off from the remaining ash.

Moreover, it should be noted that the two stage incineration of biomass in keeping with present invention will only occur in a hot hearth system, as discussed below; and that the first, gasification, stage will typically occur without the necessity for additional oxygen, and at a slightly lower temperature, than the second, carbon, stage. Also, typically additional oxygen, usually as air, is provided to the side of the incinerator where the carbon stage incineration takes place.

The present inventor has discovered that biomass waste may be effectively the sole fuel which functions to ensure its own destruction by pyrolysis, once the incineration and gasification process has been initiated. Moreover, in keeping with present invention, because of the exchange of heat between adjacent primary chambers as well as the exchange of heat between underlying secondary gasification chambers to their respective primary chambers, incineration and gasification process may be faster and will be more fuel-efficient as to the requirement for additional fuel which may be required in secondary burner members as described hereafter.

It will be noted hereafter that the present invention comprises a so-called a "hot hearth system"; meaning that the charge of biomass waste which is to be incinerated will reside over a very hot hearth which is heated from below in the manner discussed hereafter.

Moreover, as will be discussed hereafter, the present invention presents a continuing batch operation for the incineration of biomass waste, rather than by way of batch processes which require cooling and heating cycles of the incinerator. Obviously, if incineration of a biomass waste can be accomplished using a more-or-less continuous process, thereby effectively avoiding significant cool-down and heat-up of the incinerator, then very consequential savings in energy can be accomplished.

BRIEF DESCRIPTION OF THE DRAWINGS

Embodiments of this invention will now be described by way of example in association with the accompanying drawings in which.

DESCRIPTION OF THE PRIOR ART

Nearly all biomass incineration takes place in an incinerator that comprises at least two chambers—a primary chamber into which the biomass charge is placed for incineration, and either a secondary or heat transfer chamber that is in heat transfer relationship to the primary chamber, or an afterburner chamber that passes to the exit flue for the incinerator.

In order to obtain volatization of all of the biomass material in the primary chamber, it is necessary to break the bonds—mainly hydrogen-carbon bonds—between the various molecules. This breaking of the bonds is essentially a chemical reaction, generally an endothermic chemical reaction, and requires that an amount of external heat energy be introduced into the material in order for the various reactions to take place. Oxidation reactions are exothermic, these reactions provide for the release of heat energy from the reacted materials. This released heat energy in the afterburner chamber tends to cause an increase in the temperature in the primary chamber, which increase in temperature therefore tends to urge those materials towards their volatilization temperatures.

If the external heat energy introduced into the biomass material is at a very high temperature or is applied very abruptly, especially in a concentrated area, then two things tend to happen: Firstly, any reactions that occur tend to be rather violent, thus causing the production of fly-ash into the fumes of the volatilizing biomass; secondly, the sudden and concentrated reactions produce a large amount of heat energy, which in turn can cause the abrupt volatilization of the surrounding material, which volatilization can be somewhat violent. Further, if a substantial amount of material is volatilized, in the manner discussed immediately above, over a relatively short period of time, then the ambient temperature of the primary chamber will tend to rise substantially, thus causing the remaining biomass to be volatilized more quickly, but not at a controlled rate. In other words, the reaction is, at least to some degree, out of control.

In order to have a continuing volatilization reaction that is generally controllable and that is free from abrupt changes in heat generation rates and reaction rates, and which is therefore relatively free from abrupt physical disturbances, it is necessary to apply external heat energy so as to effect a continuing slow rise in temperature of the biomass material to its volatilization point.

All known prior art incinerators and cremators are designed to use relatively forceful techniques, in terms of the application of heat to a biomass material, in order to volatilize the biomass material. Essentially, all known prior art incinerators use "brute force" to cause the required volatilization, based on the assumption that more heat energy input will cause more chemical reaction and volatization.

Figure 1:
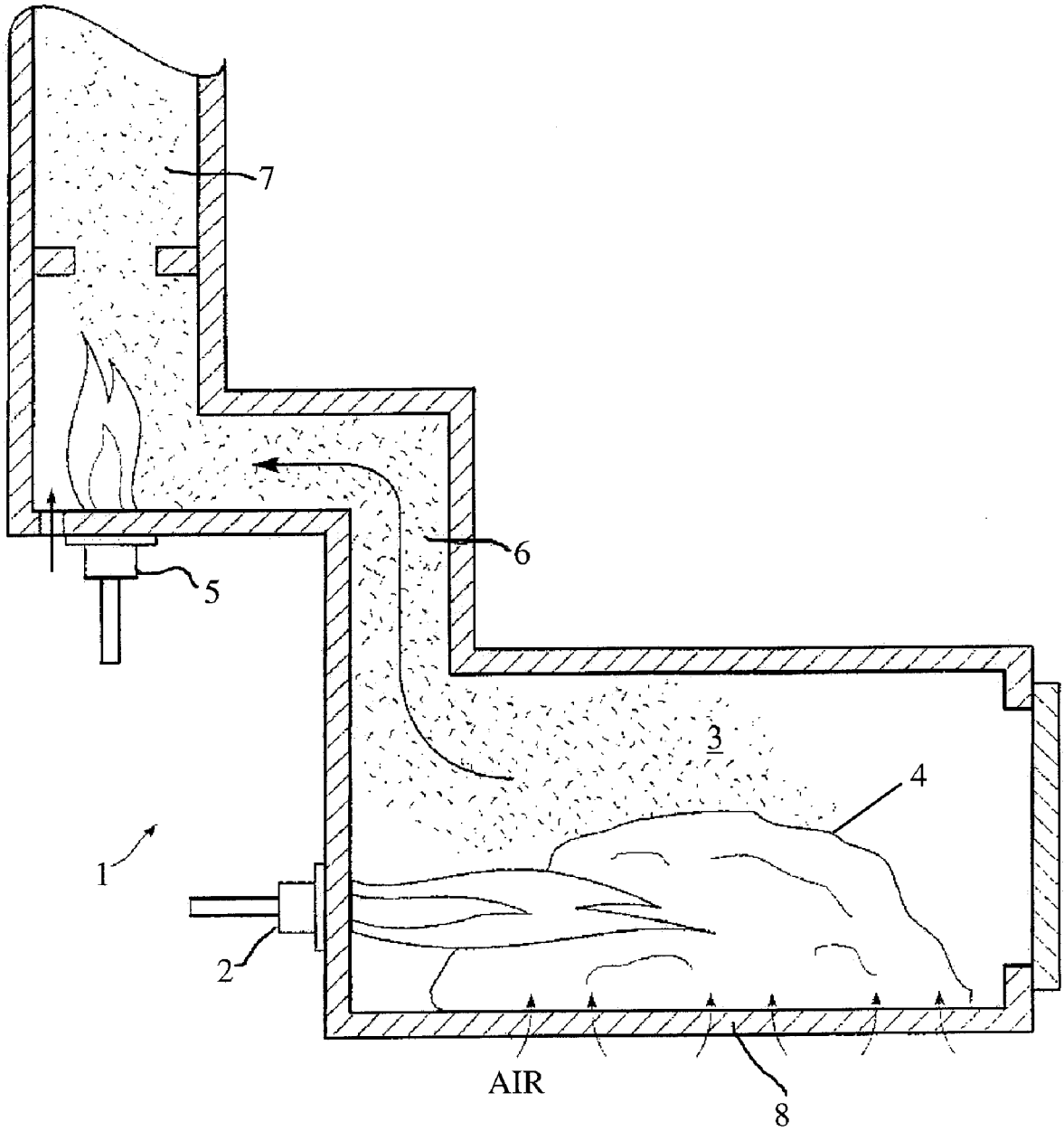
FIG. 1 (PRIOR ART)
FIG. 1 is a sectional side elevation view of a first prior art incinerator.

Traditional incinerators and cremators, an example of which is shown in prior art FIG. 1, and as indicated by general reference numeral 1, employ two or more burners, with a first burner 2 being in the primary chamber 3 of the incinerator 1—the primary chamber being where the biomass charge or other material for incineration is placed—and a second burner 5 being located in the fume vent 6. The first burner 2 in the primary chamber 3 is directed at the biomass 4 and is intended to initially ignite the biomass 4. It is found, however, that the fumes that are driven off contain a great quantity of materials, such as fly-ash, having hydrogen-carbon bonds, and other unincinerated materials. Therefore, the second burner 5 is included so as to act as an afterburner to further burn the materials that are found in the fumes. However, relatively large pieces of material, such as fly-ash, may contain several million or billion molecules; and, accordingly, such pieces of material as are borne by the fumes may not get fully incinerated in the time that they take to pass through the afterburner chamber 7.

The first burner 2 in the primary chamber 3 is aimed directly at the biomass 4, or other material to be incinerated, so as to cause direct burning of the biomass 4. The flame tends to cause the biomass waste to inflame and also tends to physically agitate the biomass 4. As a result, an undesirably high amount of fly-ash is included within the fumes from the burning biomass 4. The fumes and the fly-ash contain unburned materials which may be organic materials, and which also might include unwanted dangerous chemicals such as dioxins, furans and organo-chlorides.

Further, this type of conventional prior art incinerator 1 does not provide sufficient heat intensity on an overall basis to properly incinerate all of the waste material. Only localized heat is provided by way of the first burner 2 within the primary chamber 3, which first burner 2 incinerates the exterior of the biomass 4, and also by way of the floor 8 of the primary chamber 1, which floor 8 eventually heats up sufficiently so as to cause burning of the biomass 4 immediately in contact with it. There is often not enough heat intensity to cause complete gasification even of the materials that do burn, and certainly not enough heat intensity to cause complete gasification of the waste material at the centre of the biomass. Indeed, it has been found that the waste material at the centre of the biomass charge 4 does not burn much at all. The ash that is produced is still black, which indicates that the ash is composed largely of carbon. It has been found that typically there is also undesirable material such as dioxins, furans and organo-chlorides, and other organic matter. This black ash is typically about 10% to 15% by volume of the original waste material (and about 15% to 25% by weight).

Figure 2:
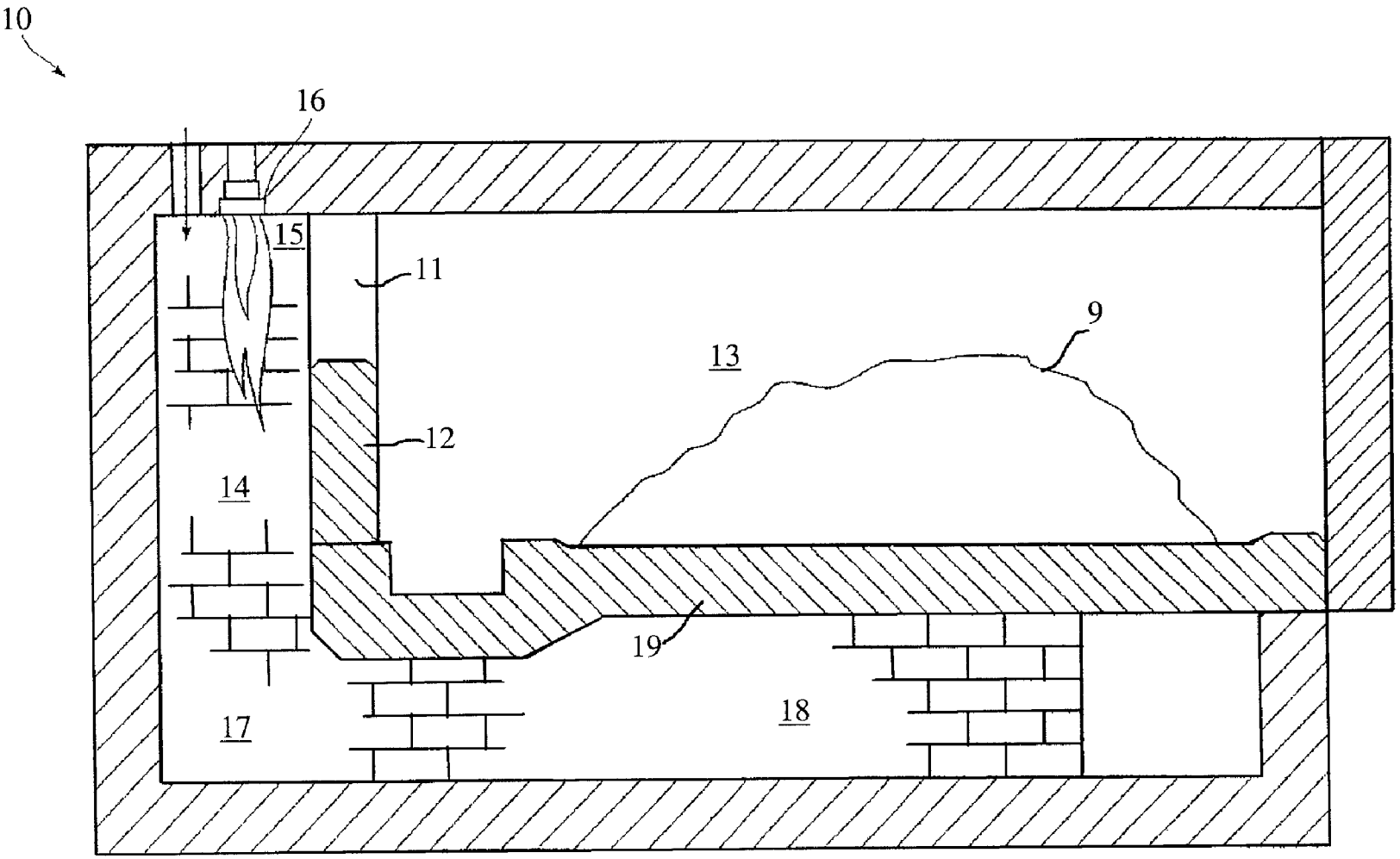
FIG. 2 (PRIOR ART)
FIG. 2 is a sectional side elevation view of a second prior art incinerator.

FIG. 2 discloses an improved incinerator and cremator that overcomes some of the problems encountered with conventional prior art incinerators and cremators. This incinerator is essentially that which is taught in the present inventor's U.S. Pat. No. 4,603,644, issued Aug. 5, 1986. The incinerator and cremator taught in that patent, and as indicated by the general reference numeral 10, has a vent 11 in the back wall 12 of the primary chamber 13, which vent 11 leads to a vertically disposed flame chamber 14. The flame chamber 14 comprises a first mixing chamber 15 wherein the flame from the sole burner member 16 mixes with the fumes from the primary chamber 13, and an afterburner chamber 17 where the fumes from the mixing chamber 15 are reacted—so as to break the hydrogen-carbon bonds—and gasify the materials in the fumes. This process is known as "cracking". The afterburner chamber turns a 90° corner, where the majority of "cracking" takes place. A relatively short horizontally disposed portion of the afterburner chamber 17 leads into a generally horizontally disposed heat transfer chamber 18. The heat from the "cracking" of the hydrogen-carbon bonds in the afterburner chamber 17 causes an elevation of temperature of the heat transfer chamber, to about 1000° C. The heat within the heat transfer chamber rises through the roof 19 of the heat transfer chamber, which is also the floor of the primary chamber, so as to heat the primary chamber and the biomass 9 within the primary chamber 13. In this manner, the biomass 9 receives conductive and convective heat from the heat transfer chamber 18, which conductive and convective heat assist in the heating of the biomass 9 in the primary chamber 13. The burner member 16 is located at the top portion of the mixing chamber 15, immediately beside the vent 11 from the primary chamber 13. Accordingly, the flame from the burner member 16 provides direct radiant heat into the primary chamber 13 through the vent 11. This direct radiant heat reaches the biomass 9 being incinerated and partially assists in the heating of the biomass 9 (known as "direct radiant heat volatilization"). Such incineration by way of direct radiant heat tends to cause burning of the biomass 9 so as to cause premature ignition which leads to incomplete combustion in the early stages of the process.

All known prior art incinerators and cremators use one or more, and possibly even several, control systems in order to try to stabilize the temperature within the primary chamber. It has been found that the use of such multiple control systems tends to produce an overall system wherein the temperature in the primary chamber may vary and, therefore, cannot be considered stable. Such lack of stability is caused by the plurality of control systems essentially working against each other.

It has been found that such prior art incinerators and cremators as discussed above, due to the inherent nature of the incineration process that occurs, produce an unacceptable end product. The fumes that are produced have relatively high levels of hydro-carbons, dioxins, furans, among other materials and substances, and also may contain fly-ash, while the resulting ash remaining in the incinerator may have unwanted organic matter such as bacteria, viruses, and other microorganisms. It can therefore be seen that incineration of biomass waste and related volatile solids is generally unacceptable as it does not render potentially infectious waste totally safe.

Figure 3:
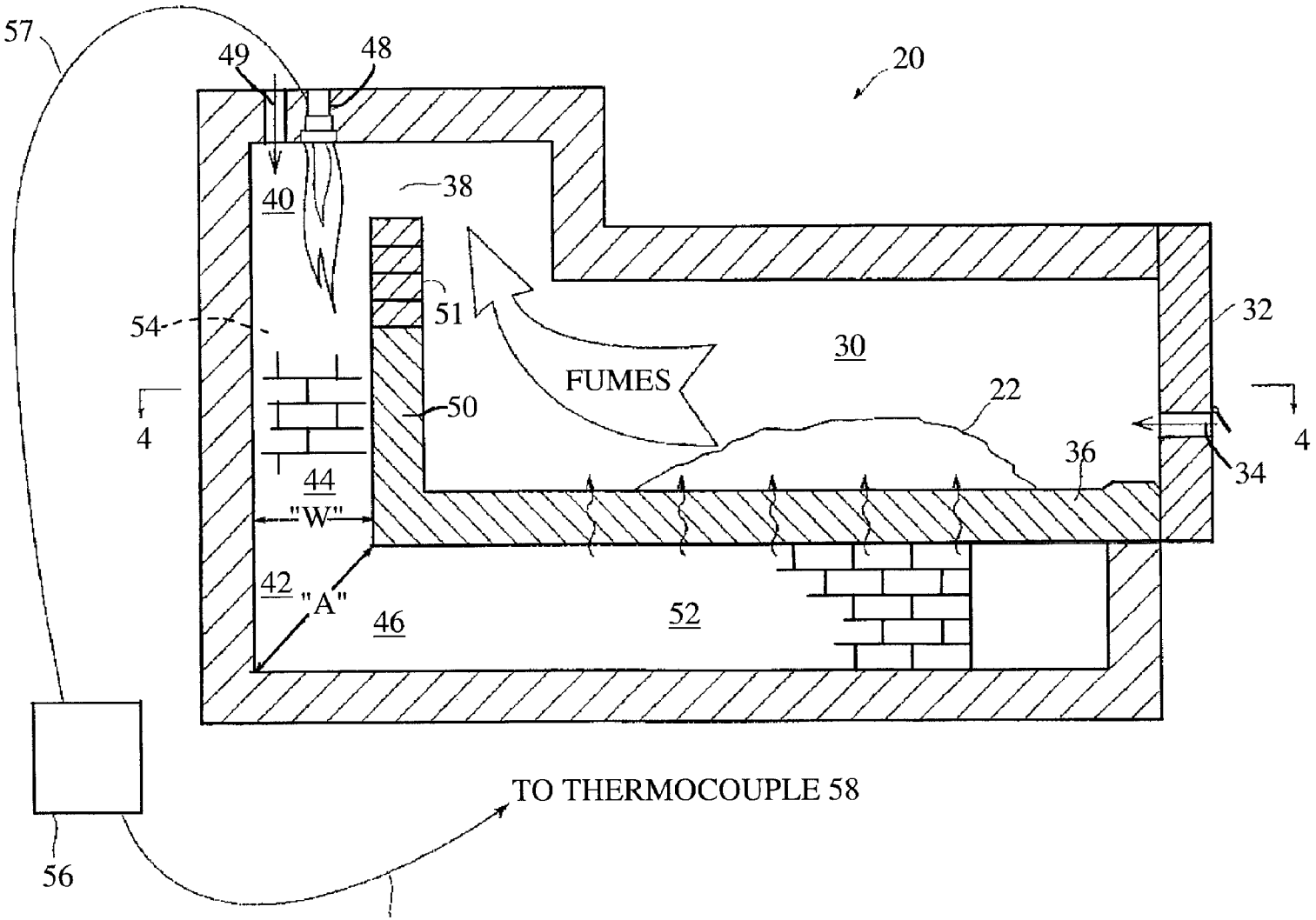
FIG. 3 (PRIOR ART)
FIG. 3 is a sectional side elevation view of a third prior art incinerator.
Figure 4:
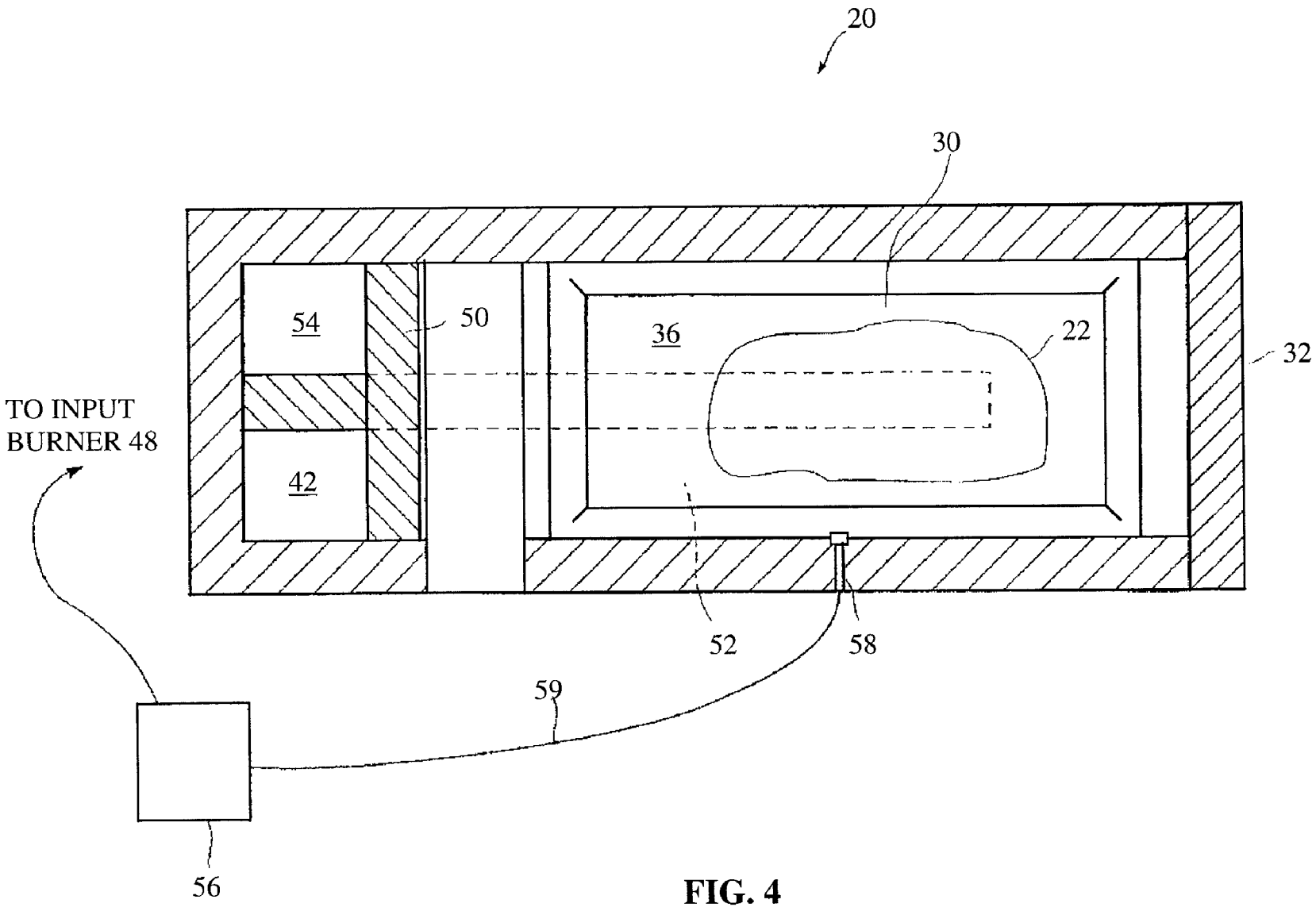
FIG. 4 (PRIOR ART)
FIG. 4 is a plan view of the third prior art incinerator.

A further prior art approach is that which is taught in FIGS. 3 and 4, which show a gasifier indicated by the general reference numeral 20. This gasifier 20 is that which is shown in the present inventor's U.S. Pat. No. 5,611,289 issued Mar. 18, 1997, and U.S. Pat. No. 6,116,168 issued Sep. 12, 2000. The gasifier 20 comprises a primary chamber 30 shaped to receive therein a charge of waste material 22 to be gasified. The primary chamber 30 includes a main door 32 to permit selective access to the primary chamber. A low volume air inlet 34 may be included in the door member 32 for permitting the inflow of small amounts of air or oxygen into the primary chamber 30. The floor 36 of the primary chamber 30 is made of a suitable refractory material so as to be strong enough to support the weight of any material placed therein, which may be several thousand pounds. The floor 36 is also heat-conductive so as to allow heat to enter the primary chamber 30 from below.

A fume transfer vent 38 is located at the back of the primary chamber 30 and disposed near the top of the primary chamber. The fume transfer vent 38 is in fluid communication with the primary chamber 30 so as to permit the escape of fumes from the primary chamber 30 when the charge of waste material 22 is being gasified therein. The fumes from the fume transfer vent 38 comprise gases and also molecules having hydrogen, carbon, and oxygen atoms therein, with many of the constituents having hydrogen and carbon bonded together, accordingly with hydrogen-carbon bonds.

A vertically disposed mixing chamber 40 is in fluid communication with the fume transfer vent 38 and thereby accepts the fumes from the primary chamber 30. An afterburner chamber 42 is in fluid communication with the mixing chamber 40. In the preferred embodiment, the afterburner chamber has a vertically disposed first portion connected at a 90° corner, as indicated by double-headed arrow "A", to a horizontally disposed second portion 46. The "corner to corner" width at the 90° corner is greater than the width of the afterburner chamber 42 so as to maximize the effect of the afterburner chamber 42, as will be discussed in greater detail subsequently. The afterburner is thereby shaped and dimensioned to permit the heating flame to fully oxidize substantially all of the constituents of the fumes from the primary chamber.

A burner member, in the form of an auxiliary heat input burner 48 is situated at the top of the mixing chamber and is oriented so as to project a heating flame downwardly through the mixing chamber 40 and into the first vertically disposed portion of the afterburner chamber 42. The heating flame from the auxiliary heat input burner 48 causes additional oxidization of the constituents of the fumes so as to completely resolve the main portion of these components into carbon dioxide and water vapor—water vapor being a gas at and above temperatures of about 100° C.

The mixing chamber permits mixing of the constituents of the fumes from the primary chamber 30 with the ambient air in the mixing chamber and also with the oxygen from an oxygen inlet 49 that is juxtaposed with the auxiliary heat input burner 48.

The auxiliary heat input burner 48 has a fuel inlet and an air inlet to permit the supply of fuel and oxygen gas, respectively, to the input burner 48. A control means is operatively connected to the input burner 48 by way of wires 57, and is used to control the supply of fuel to the input burner 48. It is typically necessary to adjust the flow of fuel to the auxiliary heat input burner 48 initially so as to produce a substantial heating flame that extends into the afterburner chamber 42. As the afterburner chamber 42 generally increases in temperature, the flow of fuel to the auxiliary heat input burner 48 is typically decreased, as less input is required to keep the afterburner chamber 46 at a generally constant temperature once the gasification process is underway.

A partitioning wall 50 is disposed between the mixing chamber 40 and the primary chamber 30 and also between the vertically disposed first portion 44 of the afterburner chamber 42 and the primary chamber 30. The partitioning wall 50 is positioned and dimensioned to preclude the heating flame produced by the auxiliary heat input burner 48 from entering the primary chamber 30, and also to preclude the radiation from the heating flame from directly entering the primary chamber 30. In this manner, the heating flame does not directly heat the waste material 22 in the primary chamber and, therefore, does not abruptly overheat a localized area of the material. Particularly, the partitioning wall 50 precludes physical agitation of the material 22 by the heating flame from the auxiliary heat input burner 48, thereby precluding the production of fly-ash from the waste material 22 as the material 22 is being heated and gasified.

The partitioning wall 50 is variable in height by way of the subtraction or addition of bricks 51 therefrom, so as to allow for "fine tuning" of the cross-sectional area of the fume transfer vent 38. Typically, the fume transfer vent 38 is kept as large as reasonably possible so as to allow for ready escape of the fumes from the primary chamber 30. In the afterburner chamber 42, the hydrogen-carbon bonds in the various materials, among other bonds, break down and oxidize so as to produce a net exothermic reaction. The breaking of the hydrogen-carbon bonds, which is known in the industry as "cracking", takes place largely at the 90° corner between the vertically disposed first portion 44 and the horizontally disposed second portion 46 of the afterburner chamber 42. This corner is referred to as the "cracking zone".

As the fumes exit the horizontally disposed second portion 46 of the afterburner chamber, they enter the heat transfer chamber 52. The heat from these exothermic reactions causes the heating of the heat transfer chamber 52 to a very high temperature, ultimately to about 1000° C. This temperature is, of course, adjustable by way of the control means 56 of the auxiliary heat input burner 48. As the heat from the "cracking" of the hydrogen-carbon bonds, in addition to the residual heat from the auxiliary heat input burner 48, increases the temperature within the heat transfer chamber 52, the control means 56 can be used to decrease the heating flame being projected from the auxiliary heat input burner 48. This control means 56 can be interfaced with a thermocouple 58 that senses the temperature within the heat transfer chamber 52. The thermocouple 58 is electrically connected by way of wires 59 to the control means 56 so as to provide feedback signals to the control means, thereby allowing for automatic adjustment of the heating flame from the auxiliary heat input burner 48. The heat transfer chamber 52 is bifurcated so as to increase the effective length of the heat transfer chamber 52, thus increasing the amount of time the hot gases within the heat transfer chamber are exposed to the floor 36 of the primary chamber 30 above, and thereby permitting more heat to be transferred from the heat transfer chamber 52 to the primary chamber 30.

The primary chamber 30 is superimposed on the heat transfer chamber 52, with the heat conductive floor 36 disposed in separating relation therebetween, such that the heat from the heat transfer chamber 52 passes through the heat conductive floor 36 so as to permit conductive and convective heating of the primary chamber 30, to thereby increase the temperature of the primary chamber 30.

The heat transfer chamber 52 is in fluid communication with a vertically disposed exhaust vent 54 located at the rear of the primary chamber 30. The exhaust vent 54 allows for the safe venting of the oxidized fumes into the ambient surroundings.

The temperature within the primary chamber can be controlled in two ways: First, the auxiliary heat input burner 48 is modulated by way of the control means 56 receiving feedback from a thermocouple 58 within the heat transfer chamber 52. The fuel input, and therefore the size of the flame from the auxiliary heat input burner 48, is selected according to the temperature experienced by the thermocouple 58. Second, a small amount of air can be permitted to pass into the primary chamber 30 by way of the low volume air inlet 34 in the main door 32 of the primary chamber 30. Permitting a very small amount of air into the primary chamber 30 can raise the temperature within the primary chamber 30.

When the auxiliary heat input burner 48 is started, the heats from the auxiliary heat input burner 48 heats up the heat transfer chamber 52, so as to thereby slowly and steadily cause a rise in temperature of the primary chamber 30. As the temperature in the primary chamber 30 rises, volatilization of the low enthalpy portions of the waste material 22 starts to occur, as the low enthalpy material 22 has, by definition, lower bond energy. The exothermic reactions of the low enthalpy material 22 which occur in the primary chamber 30 and in the "cracking zone" of the afterburner chamber 42, combine with the heat from the auxiliary heat input burner 48 to continue to heat up the heat transfer chamber 52, so as to cause a steady and continuous rise in the temperature within the primary chamber 30. As the temperature within the primary chamber 30 increases, the higher enthalpy portions of the waste material 22 are volatilized, thus producing even more heat energy from the resulting exothermic reactions. This increased heat energy continues to combine with the heat energy from the auxiliary heat input burner 48, so as to continue to add heat into the heat transfer chamber 52 and, accordingly, increase the temperature of the primary chamber 30. Thus, there is a steady and continuous increase in the amount of heat energy given off by way of exothermic reaction of the waste material 22 over time. All the while, the thermocouple 58 in the primary chamber 30 allows for monitoring of the temperature of the heat transfer chamber 52 and permits the auxiliary heat input burner 48 to modulate itself so as to preclude the heat within the heat transfer chamber 52 from rising excessively. Essentially, the increase in temperature within the primary chamber 30 is based on the slow rise in heat energy from the continuing exothermic reactions of the material 22.

SUMMARY OF THE INVENTION

In accordance with one aspect of the present invention, there is provided an incinerator and gasifier for gasifying biomass waste in alternately loaded batches thereof.

There are first and second primary chambers which are adapted to receive biomass waste therein for incineration and gasification thereof.

First and second fume transfer vents are disposed near the top of said first and second primary chambers, respectively, and in fluid communication therewith so as to permit the escape of fumes from the first and second primary chambers, respectively.

First and second afterburner chambers are in fluid communication with the first and second mixing chambers, respectively.

There are first and second secondary burner members in the incinerator and gasifier which are such as to produce an initial flame within a first vertically disposed portion of each of the first and second afterburner chambers, respectively, and wherein each of the first and second secondary burner members has a respective fuel inlet and an air inlet to permit the supply of fuel and oxygen to the respective secondary burner members There are also first and second control means to control the supply of fuel and oxygen to the respective first and second secondary burner members;

First and second partitioning walls are disposed at the rear of the first and second primary chambers, respectively, so that the tops of the partitioning walls define the bottom limits of the first and second transfer vents, respectively.

First and second secondary heat transfer chambers are in fluid communication with the first and second afterburner chambers, respectively, so that heated gases flowing from the respective afterburner chambers cause heating of the respective secondary heat transfer chambers.

There is a heat conductive and refractive partitioning wall which separates the first and second primary chambers one from the other.

Also, a portion of each of the first and second primary chambers overlies the respective first and second secondary heat transfer chambers and is separated therefrom by a heat conductive and refractive horizontal partitioning member.

Finally, there is an exhaust duct disposed between the first and second secondary heat transfer chambers and in fluid communication with a vertically disposed exhaust stack for conducting exhaust gases away from the first and second secondary heat transfer chambers.

The incinerator and gasifier of the present invention is such that the dwell time of any load in either of the first or second primary chambers is in the range of 15 minutes to three hours.

The nature of the load being incinerated and gasified in each of the first and second primary chambers may differ from the nature of the load being incinerated and gasified in the other of the first and second primary chambers.

The incinerator and gasifier of the present invention is such that the entire structure comprising the first and second primary and secondary chambers, the first and second transfer vents and mixing chambers, the first and second afterburner chambers and secondary burner members, and all of the refractory and heat conductive and refractory walls, tops, floors, and partitions, are mounted on a wheeled platform so as to permit the incinerator and gasifier to be mobile.

Also, the incinerator and gasifier of the present invention is such that the load to be incinerated and gasified in each of the first and second primary chambers may be placed into the respective primary chamber through the end thereof remote from the exhaust stack, or through the top defining wall of each of said respective primary chambers.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 5:
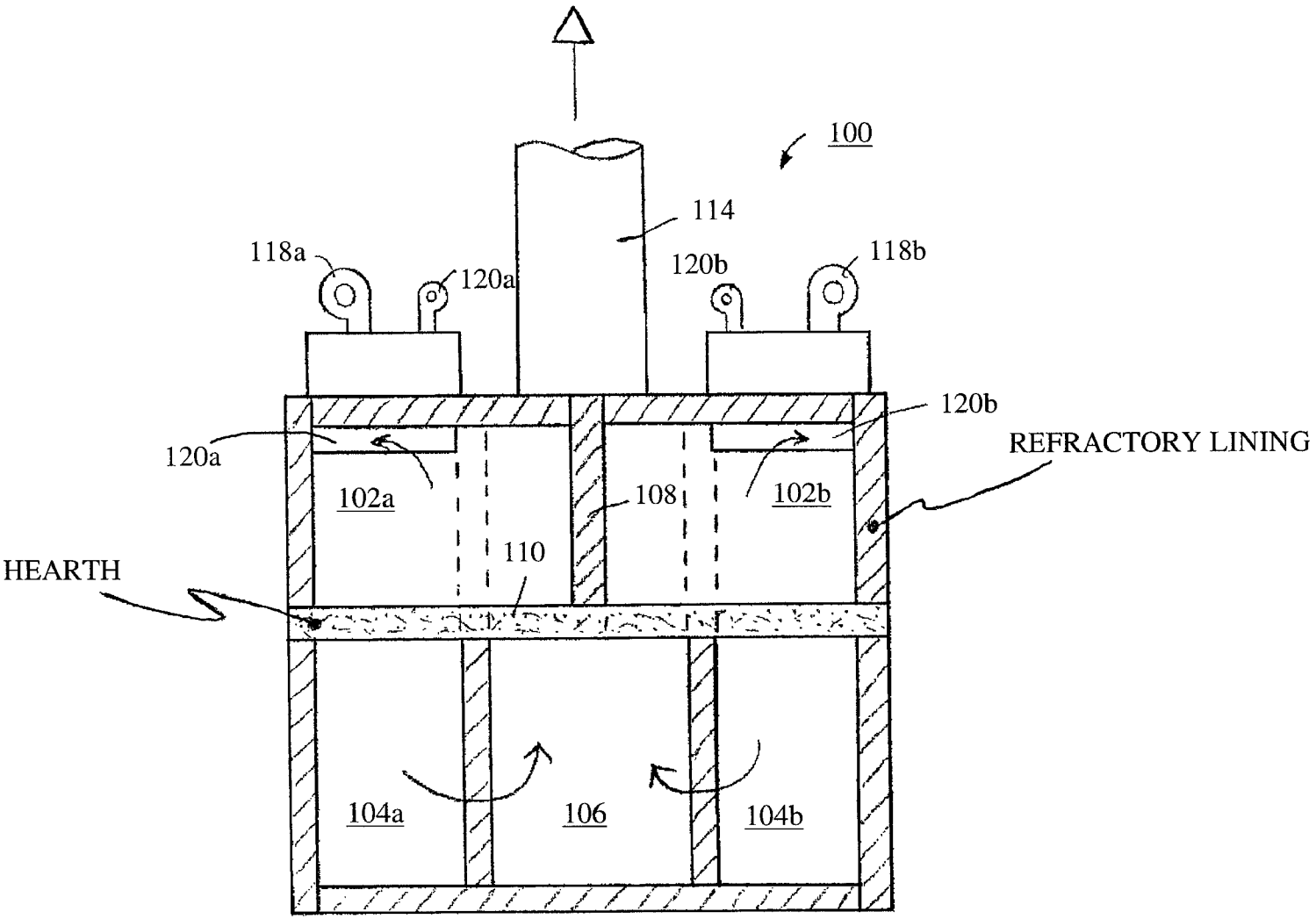
FIG. 5 is a simplified front cross-section of a biomass gasifier and incinerator in keeping with present invention.
Figure 6:
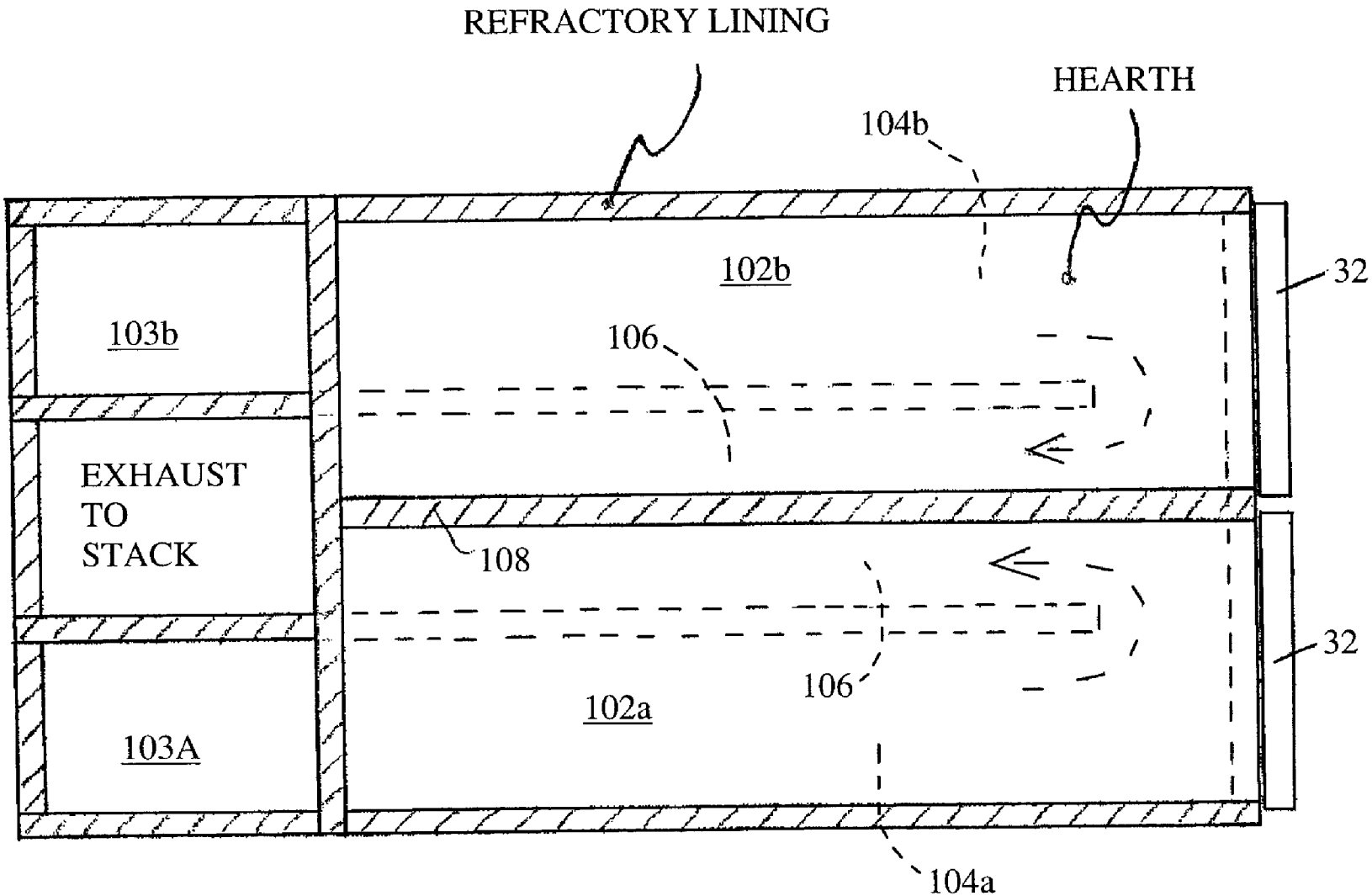
FIG. 6 is a simplified plan view of a biomass gasifier and incinerator in keeping with the present invention.

Turning first to FIGS. 5 and 6, simplified views of a biomass gasifier and incinerator in keeping with the present invention are shown. The biomass gasifier and incinerator is identified generally with the numeral 100, and comprises two primary chambers 102*a* and 102*b*, two afterburner chamber 103*a* and 103*b*, two secondary chambers 104*a* and 104*b*, and an exhaust duct 106. As will be described hereafter, a biomass load will be placed into primary chamber 102*a*, and after a prescribed period of time another biomass load will be placed into primary chamber 102*b*. Typically, that prescribed period of time is one half the time that it will take the load in the first primary chamber to become totally incinerated and gasified. By alternately placing loads in the primary chambers 102*a* and 102*b*, it will be seen that the so-called "continuing batch loading system" will be operative, and that the throughput will therefore be approximately twice that which would normally be that of a single gasifier and incinerator such as that described relative to FIGS. 3 and 4.

The biomass which is intended to be gasified and incinerated in keeping with the present invention may, as noted above, comprise macerated animal bits or parts, or it may even include the entire bodies of fish and foul. For example, in the event of an outbreak of avian flu, health workers outfitted in appropriate biohazard suits would typically kill all of the foul such as by gassing, and then place the dead foul in plastic bags which would then be sealed. Thus, any infected foul would be isolated from potential communication of airborne contaminants to the atmosphere; and once they have been incinerated and gasified the contaminants will have been pyrolyzed, and therefore molecularly disassembled. The biomass waste may comprise from 5% up to 100% solids, with the rest being water. Some biomass waste may have a high energy content. For example, ground up animal parts such as meat and bone, having a relatively high fat content, will comprise a high energy content.

The gasifier and incinerator 100 may be constructed using typical refractory materials from which such devices are normally made, being structural materials that will withstand temperatures in the range of 850° C. to 1000° C.; and in some cases, up to as high as 1300° C. However, particularly if the devices are such as to be mobile, so as to be hauled along roadways and the like on trailers, then the refractory material may be other lightweight material which is also capable of withstanding the temperatures to which it will be exposed. The nature of that refractory material is beyond the scope of the present invention; but it should be noted that at least the refractory material that is used for the construction of the partitioning wall 108 between the first and second primary chambers 102*a* and 102*b*, and also the hearth or floor/ceiling which defines the bottoms of the first and second primary chambers 102*a* and 102*b*, and also the tops of the first and second secondary chambers 104*a* and 104*b* and the top of the exhaust duct 106, must be such that it will conduct heat through its thickness from one chamber to the adjacent chamber above or beside it. In other words, the walls 108 and 110 will have little resistance to heat flow once they have reached their soaking temperature.

The basic structure and operation of the gasifier and incinerator 100 is not unlike that of the prior art device 20 which is discussed in reference to FIGS. 3 and 4. Thus, it will be seen that the exhaust duct 106 is in fluid communication with the vertically disposed stack 114; and it will be understood that the gases flowing in the exhaust duct 106 are generally at a lower temperature than those which are flowing in the secondary chambers 104*a* and 104*b*, because the gases will have given off heat to the heat conductive hearth 110.

An auxiliary or secondary burner 118*a* and 118*b* is provided, together with a secondary air fan 120*a* and 120*b*, for each side of the incinerator and gasifier 100, as a seen in FIG. 5. The purpose of the secondary burners 118*a*, 118*b*, is to provide an initial or start-up flame to the respective side of the incinerator and gasifier when the otherwise continuing batch load operation of the gasifier and incinerator in keeping with the present invention is initiated.

Fuel is provided to the secondary burners 118*a* and 118*b*, and the secondary air fans 120*a* and 120*b* are operated, so as to establish heat in the vertical portion of the afterburners 103*a* and 103*b*. That heat will, of course, cause gases to flow through the respective secondary chamber 104*a* or 104*b*, into the exhaust duct 106, and up the stack 114. However, as those gases become hotter, more heat is transferred to the biomass waste which is resident on the hearth 110, In fairly short time, the biomass waste will be heated sufficiently so as to begin to emit gases including water and volatile organic compounds such as methane and the like. As more and more of these volatile organic compounds are given off, they will pass into a respective transfer vent 120*a* or 120*b*, and thence into the respective secondary chamber 104*a* or 104*b*, through the respective vertical afterburner portion 103*a* or 103*b*.

Eventually, those gases are sufficiently hot so that they require little if any additional heat input from the respective secondary burner 118*a* or 118*b*, which may then be turned off. Of course, sufficient monitoring and control means are provided to ensure that the temperature in the secondary chambers 104*a* and 104*b* is high enough to transfer sufficient heat to the biomass waste overlying the secondary chambers in order that the carbon phase of the gasification and incineration process, as described above, may take place. If additional heat is required, then the respective secondary burner 118*a* or 118*b* will be started as necessary.

Figure 7:
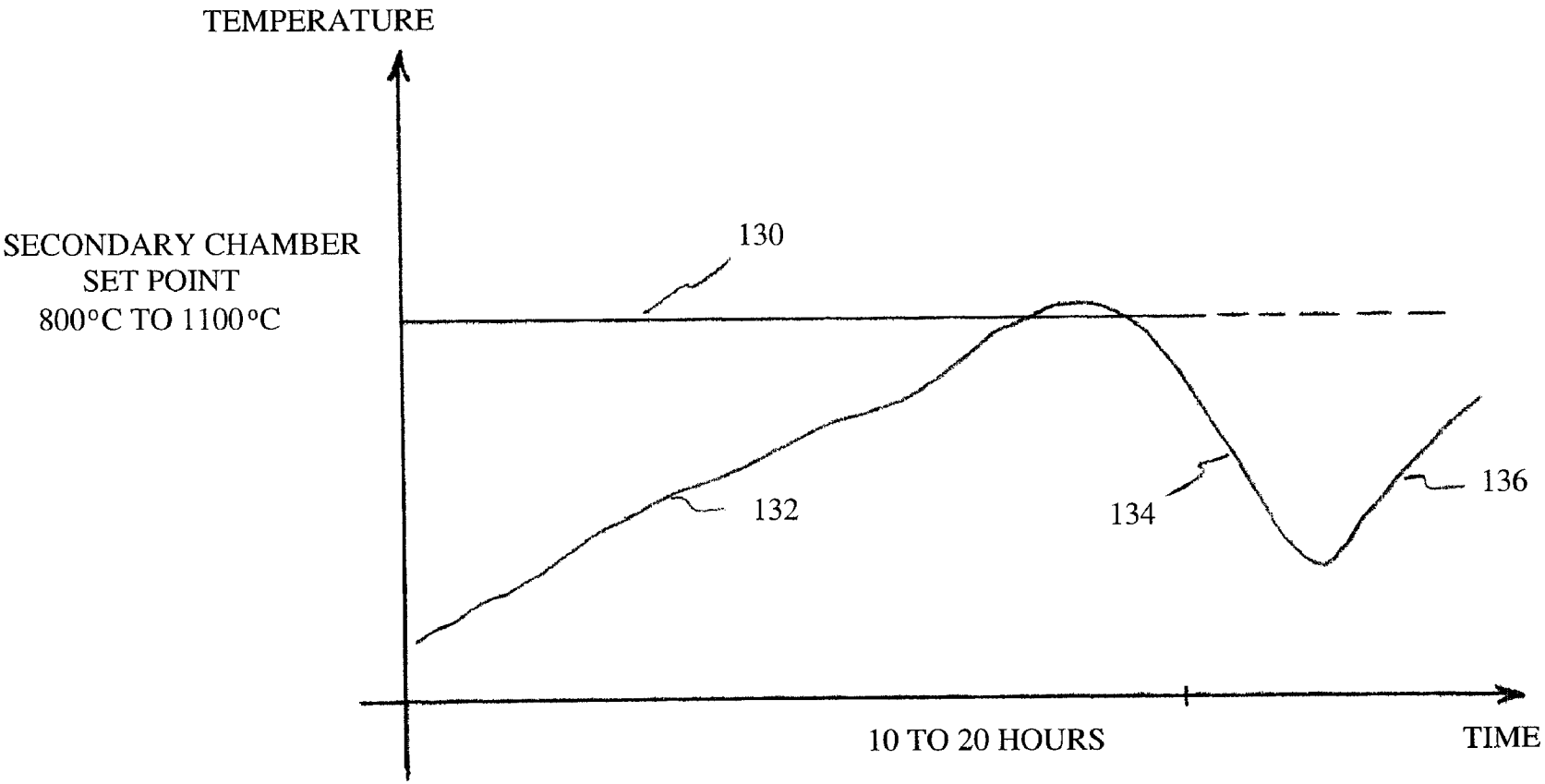
FIG. 7 is a simplified chart of temperature versus time in a prior art incinerator.
Figure 8:
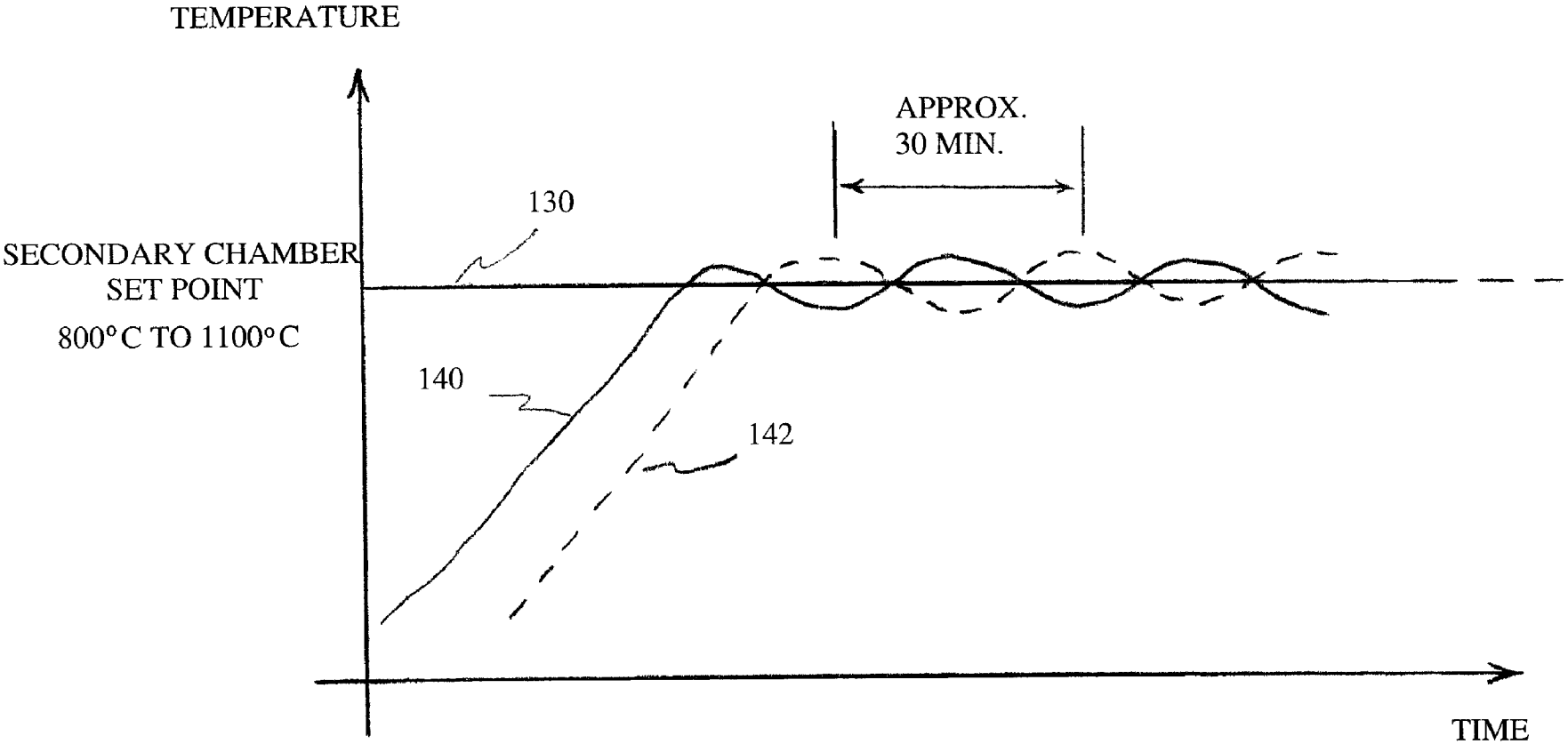
FIG. 8 is a simplified chart of temperature versus time in a dual chamber biomass gasifier and incinerator in keeping with the present invention.

Turning now to FIGS. 7 and 8, temperature versus time charts are shown for a prior art incinerator and gasifier, and an incinerator and gasifier in keeping with the present invention. In each of FIGS. 7 and 8, a line 130 is shown at 850° C. The curve 132 is a typical curve showing the rise of temperature within a single primary chamber of a prior art incinerator such as that shown in FIGS. 3 and 4. It will be seen that typically the temperature within the single primary chamber may overshoot the intended temperature by a little bit, but it will fall back. In any event, after a period of time the charge in the single primary chamber will have been entirely incinerated and gasified, and the primary chamber will be opened to place a new charge into it. The temperature will then be depressed as shown at 134; and it will then begin to rise again as indicated at 136.

On the other hand, it will be seen in FIG. 8 that there will be two temperature curves 140 and 142 superimposed one on the other. A time lapse occurs between them, which is typically one half the period of time that it will take the load in either of the primary chambers to become totally incinerated and gasified. At that time lapse time, however, a new load will be placed in which ever of the primary chambers 104*a* and 104*b* is now empty, and the incineration and gasification cycle will begin again. However, because the temperature in the adjacent primary chambers is substantially equal after the dividing wall 108 has reached its soaking temperature, there will be very little cooling down of the opened primary chamber because of heat flow into it from the adjacent primary chamber. Accordingly, the superimposed temperature curves as shown in FIG. 8 indicate that operation of a dual chamber incinerator and gasifier in keeping with present invention will be considerably more fuel-efficient than the prior art devices.

Figure 9:
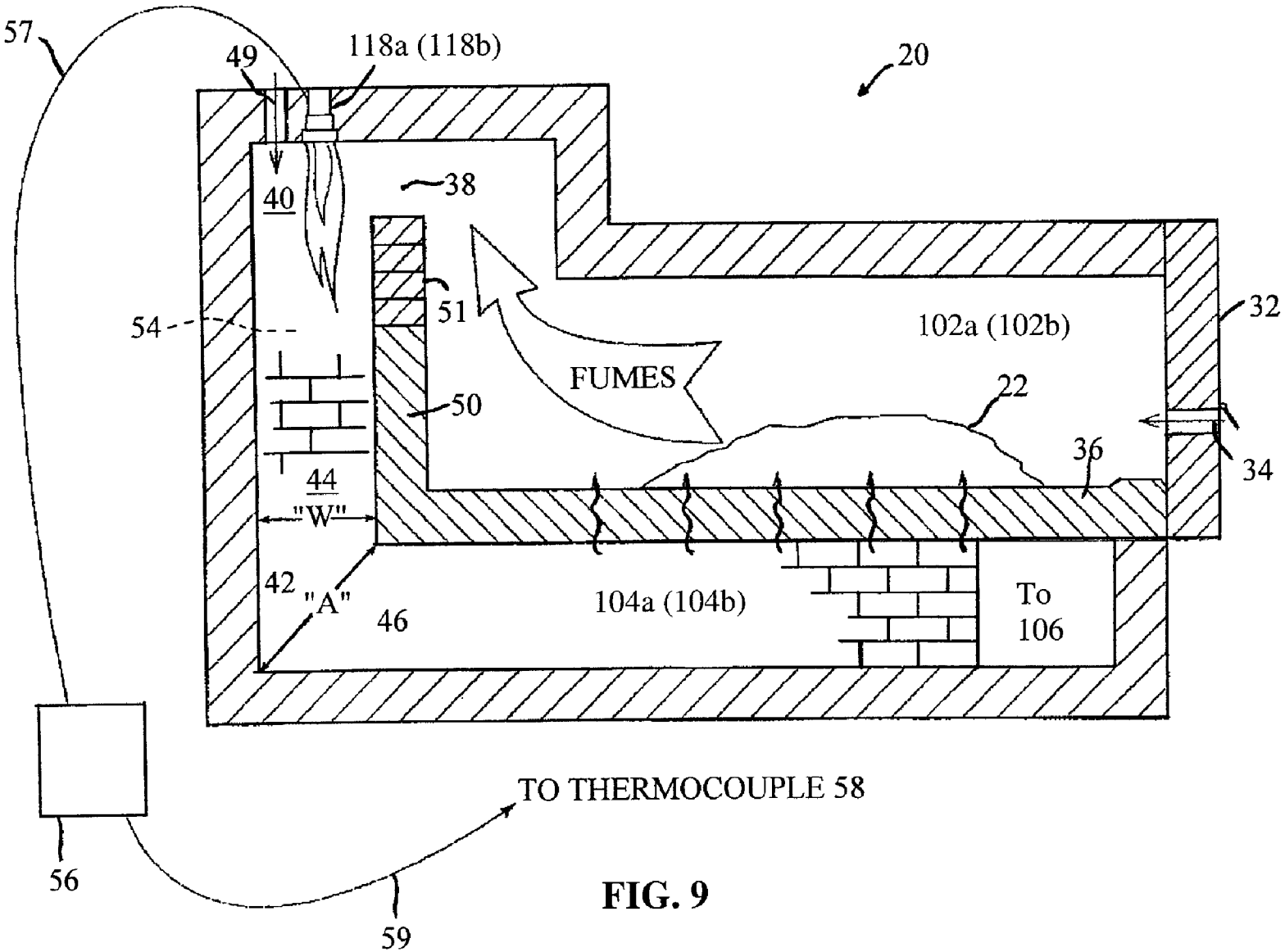
FIG. 9 is a sectional side elevation view similar to FIG. 3, but showing structural details of one side of a biomass gasifier and incinerator in keeping with the present invention.

Turning now to FIG. 9, a somewhat more specific teaching of one half of a gasifier and incinerator in keeping with the present invention is shown. It will be seen that this figure is not a dissimilar to FIG. 3, and for the most part the same reference numerals are employed to identify the same structural features. The functioning and operation of the gasifier and incinerator shown in FIG. 9 is similar to that described above with respect to the prior art incinerator shown in FIG. 3, A secondary or auxiliary burner 118*a* (118*b*) is shown, but from the above description it will be understood that its purpose is to provide an initial heating flame. Thereafter, the secondary burner 118*a* (118*b*) may or may not function, depending on the operation of the controller 56 communicating with a thermocouple 58, and with other operating controls as will be understood by those skilled in the art. On the other hand, air or oxygen is provided to the secondary or afterburner chamber through the vent 49, and will flow continuously.

It will be understood that due to the nature of the operation, and particularly since it is a continuing batch operation, once both sides of the gasifier and incinerator are fully functional, the secondary burners can be turned off or modulated to minimal fire position. In other words, the fuel for continuous operation of the gasifier and incinerator is the very biomass waste which will be gasified and incinerated. Accordingly, additional energy input requirements for the operation of the gasifier and incinerator in keeping with the present invention are minimal, once it is going. Effectively, the only additional energy input requirements are electrical such as that for any motors or fans which may be operating. However, no additional fuel requirement is made beyond that which is required for the initial start-up flame, so there is no requirement or necessity for storage of large amounts of fuels such as diesel oil or other burner oil, propane or natural gas, and so on.

Other biomass waste material that may be gasified and incinerated in keeping with the present invention may include human sewage disposal effluent. This may have certain advantages in some circumstances such as the provision of portable toilets for temporary gatherings of large numbers of people—for example, a papal visit, a concert by a famous musical group, and so on—or it may have advantages in situations where there may be a long term municipal or military establishment such as those which are found in the high Arctic where permafrost is found and sewage disposal is a problem.

In the operation of a gasifier and incinerator in keeping with the present invention, it is possible that there may be flame present in the primary chambers at the regions thereof where the carbon stage of the incineration occurs. Thus, as the biomass waste is reduced to ash in the region of the primary chamber 102*a* or 102*b* which overlies the respective secondary or afterburner chamber 104*a* or 104*b*, there may sometimes be violent flame action. However, this is precluded in the present invention due to the presence of the dividing wall 108 which separates the respective first and second primary chambers 102*a* and 102*b*.

A typical daily load for a single, dual chamber incinerator and gasifier in keeping with the present invention may be as much as 50,000 lbs. When the incinerator and gasifier in keeping with present invention is designed so as to be mobile, and is therefore placed on a trailer to be hauled from one place to another in keeping with the instructions of an authority such as the Department of Homeland Security, the Armed Forces, public health agencies, and the like, is necessary that the overall weight of the device including the weight of the trailer upon which is placed should be less than about 80,000 to 120,000 lbs. It is contemplated that as many as six trailers having dual chamber incinerators and gasifiers mounted on them will comprise a single biomass waste disposal system. Those devices, together with a macerator machine for reducing the bodies of cattle and swine, for example, to chunks not larger then 2 cm to 10 cm, and the necessary trucks to haul them, may be placed at strategic locations throughout the country, or anywhere in the world.

Typically, the stack 114 will be foldable, insertable, or telescopic, in a manner which is beyond the scope of the present invention, so that the entire device can be hauled on a so-called "low-boy" trailer on primary and secondary roads, and be able to pass under bridges and overpasses on those roads.

It is usual that a single biomass load in either primary chamber may have a weight of between 500 and 800 lbs. Moreover, the load may be placed into either primary chamber through one or two openings in the top of the chamber, or through the loading or inspection doors 32. Still further, it is possible that a conveyor may be arranged to pass through the loading door 32 so that non-macerated loads such as whole or significant portions of cattle or swine, or bagged infected foul, or the like, may be placed into either of the primary chambers. Indeed other kinds of biomass waste may include parts of trees that had been knocked down by such as a hurricane or tsunami.

The typical airflow through either side of an incinerator and gasifier in keeping with the present invention, and up through the stack 114, may be in the range of 6 to 10 ft.$^3$ per second.

It will be understood by those skilled in the art that the rates of gasification will depend on the temperature in the respective primary chamber in which the biomass waste load has been placed. If the primary chamber heats up faster, then the biomass waste will be gasified faster. However, because of the adjacent primary chamber, the temperature rise in a recently loaded primary chamber will be faster, and its cool down will be less than otherwise. Moreover, incinerators and gasifiers in keeping with present invention permit smaller loads then prior art incinerators, and particularly those which have been used to dispose of cattle that may have had or may have been in contact with cattle infected by mad cow disease. Especially if the loads comprise macerated animal parts, then the disposal time per animal will be less than previously. Moreover, significantly less fuel will be consumed on a per animal or even a per hour basis.

In operation, a typical temperature differential between the temperature of the gases as they flow through the afterburner chambers 104*a* or 104*b* and those gases flowing through the exhaust duct 106 is about 100° C. Moreover, while the gases which exit the gasifier and incinerator of the present invention through the stack 114 may be quite hot, they will contain very little or no hazardous gases or gasified compounds such as dioxins or other volatile organic compounds whose presence in the atmosphere may be unwanted or may be legislated against. A typical concentration of volatile organic compounds may be considerably less than 10 ppm, which is generally acceptable in most jurisdictions.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

I claim:

1. An incinerator and gasifier for gasifying biomass waste in alternately loaded batches thereof, said gasifier and incinerator comprising:

first and second primary chambers adapted to receive biomass waste therein for incineration and gasification thereof;

first and second fume transfer vents disposed near the top of said first and second primary chambers, respectively, and in fluid communication therewith so as to permit the escape of fumes from said first and second primary chambers, respectively;

first and second afterburner chambers in fluid communication with said first and second primary chambers, respectively;

first and second secondary burner members in said incinerator and gasifier so as to produce an initial flame within a first vertically disposed portion of each of said first and second afterburner chambers, respectively, wherein each of said first and second secondary burner members has a respective fuel inlet and an air inlet to permit the supply of fuel and oxygen to the respective secondary burner members, and first and second control means to control the supply of fuel and oxygen to said respective first and second secondary burner members;

first and second partitioning walls at the rear of said first and second primary chambers, wherein the tops of said partitioning walls define the bottom limits of said first and second transfer vents, respectively;

first and second secondary heat transfer chambers in fluid communication with said first and second afterburner chambers, respectively, wherein heated gases flowing from the respective afterburner chambers cause heating of the respective secondary heat transfer chambers;

wherein a heat conductive and refractive partitioning wall separates said first and second primary chambers one from the other;

wherein a portion of each of said first and second primary chambers overlies the respective first and second secondary heat transfer chambers and are separated therefrom by a heat conductive and refractive horizontal partitioning member; and an exhaust duct disposed between said first and second secondary heat transfer chambers and in fluid communication with a vertically disposed exhaust stack for conducting exhaust gases away from said first and second secondary heat transfer chambers.

2. The incinerator and gasifier of claim 1, wherein said first and second control means are used to control said first and second burner members so that the dwell time of any load in either of said first or second primary chambers is in the range of 15 minutes to three hours.

3. The incinerator and gasifier of claim 1, wherein the weight and piece size nature of the load being incinerated and gasified in each of said first and second primary chambers differs from the weight and piece size nature of the load being incinerated and gasified in the other of said first and second primary chambers.

4. The incinerator and gasifier of claim 1, wherein the entire structure comprising said first and second primary and secondary chambers, said first and second transfer vents and primary chambers, said first and second afterburner chambers and secondary burner members, and all of the refractory and heat conductive and refractory walls, tops, floors, and partitions, are mounted on a wheeled platform so as to permit said incinerator and gasifier to be mobile.

5. The incinerator and gasifier of claim 1, wherein the load to be incinerated and gasified in each of said first and second primary chambers may be placed into the respective primary chamber through the end thereof remote from said exhaust stack, or through the top defining wall of each of said respective primary chambers.

* * * * *